US007040888B2

(12) United States Patent
Keiffer et al.

(10) Patent No.: US 7,040,888 B2
(45) Date of Patent: May 9, 2006

(54) SMART WICK

(76) Inventors: Lisa Lynn Keiffer, P.O. Box 96, Clendenin, WV (US) 25045; Robin Marie Thornburg, 1340 Thorofare Rd., Clendenin, WV (US) 25045

( * ) Notice: Subject to any disclaimer, the term of this patent is extended or adjusted under 35 U.S.C. 154(b) by 132 days.

(21) Appl. No.: 10/865,721

(22) Filed: Jun. 10, 2004

(65) Prior Publication Data

US 2005/0277075 A1 Dec. 15, 2005

(51) Int. Cl.
*F23N 1/00* (2006.01)

(52) U.S. Cl. ..... 431/35; 431/33

(58) Field of Classification Search ..... 431/35 O, 431/33 X, 120, 289, 301
See application file for complete search history.

(56) References Cited

U.S. PATENT DOCUMENTS

| | | | |
|---|---|---|---|
| 4,818,214 | A | 4/1989 | Ronnback |
| 5,363,590 | A | 11/1994 | Lee |
| 5,899,685 | A | 5/1999 | Thigpen |
| 5,961,318 | A | 10/1999 | Chambers |
| 6,270,340 | B1 | 8/2001 | Lepp |
| 6,494,708 | B1 | 12/2002 | Hart |
| 6,508,644 | B1 | 1/2003 | Pesu |
| 2003/0124474 | A1 | 7/2003 | Elliot |
| 2003/0134246 | A1 | 7/2003 | Gray |
| 2004/0033468 | A1 | 2/2004 | Pesu |
| 2004/0091829 | A1 | 5/2004 | Mack |

FOREIGN PATENT DOCUMENTS

| | | |
|---|---|---|
| CN | 2539074 U | 3/2003 |
| WO | WO9730138 | 8/1997 |
| WO | WO0194507 | 12/2001 |

*Primary Examiner*—Alfred Basichas
(74) *Attorney, Agent, or Firm*—John J. Giblin, Jr.; Anthony P. Tokarz; Bowles Rice McDavid Graff & Love LLP

(57) ABSTRACT

Smart Wick is a wick for a candle that is designed with the ability to automatically extinguish a flame in equal-timed intervals as well as the ability to access a new wick for relighting.

9 Claims, 5 Drawing Sheets

SMART WICK

TECHNICAL FIELD

The present invention relates generally to the field of candles and candle wicks and the method of making the same, consisting essentially of a wick designed with the ability to automatically extinguish a flame in equal-time intervals and a new wick can be easily exposed for further use. This process repeats itself over the lifecycle of said candle.

BACKGROUND OF INVENTION

Description of the Prior Art

The purpose of a candle wick is to provide a candle with a flame, the heat from the flame melts the wax surrounding the base of the wick directly beneath it. The melted wax is then drawn up within the wick providing fuel for the flame. The candle continues to burn through an ongoing cycle. Wax in solid state is melted by the heat of the flame and converts to a liquid state. The liquid wax is drawn up to the top of the wick inside the flame and continues the burning process. The cycle repeats itself until the wick is no longer functioning due to lack of fuel for the flame.

The present invention interrupts the ongoing cycle in equal-time intervals by not allowing the wick segments secured in the non-flammable tubular shaped appliance from absorbing any melted wax thus stopping the flame from receiving the fuel it needs to continue the burning process. When the wick segment is used up the flame has no choice but to extinguish. The appliance is then removed to expose a new wick for relighting. This process is repeated over the entire life cycle of candle.

Candles have been used for many years and for many different reasons, the reasons vary depending on the user. Today, a large number of candles are purchased simply for their pleasant fragrances and decorative appearance. The aromatherapy derived from a candle is widely used as well. It entices the user to relax and forget about everyday responsibilities. However, one problem that exist between the user and the candle is that the user neglects to extinguish the candle. People today are simply to busy to remember to blow out a candle prior to leaving their homes. Panic sets in. A candle equipped with a wick that will automatically extinguish a candle flame in equal-time intervals would provide a user with the security of knowing that their candle will self extinguish in a short period of time.

Another problem that exists today is the vast number of house fires caused by leaving a candle unattended. The average burning time for a candle is 60–95 hours. The time frame is too long. There is a greater risk of the candle being knocked over by a house pet, wind, or even a small child. Limiting the amount of burning time from 95 hours to 1 to 4 hours would significantly reduce the risk of house fires.

There is a teaching about a wick that is self-extinguishing and reignitable. For instance, U.S. Pat. No. 0,040,091,829, states, a wick includes a first portion and a second wick portion. At least one combustion barrier is positioned between the first and second wick portions. The combustion barrier is configured to obstruct combustion from the first wick portion to the second wick portion. The present application teaches several different methods on how to accomplish this task as well as the reignition of said wick. The application explains in broad detail different configurations used to extinguish a candle in multiple timed periods.

However, a problem that exist with said method is the reignition concept described. It states that once the wick segment is used up they cut off the barrier, staple, knot or collar with scissors or a kitchen knife to expose a new wick. The problem with this concept is: 1) this method would not leave enough wick for relighting said candle. The proper amount of wick is necessary for a candle to maintain a flame. Otherwise, the flame would be low and drown in the surrounding fuel. 2) Secondly, another problem is the cutting of the barrier. A candle in a deep based container will burn to a depth impossible to reach by hand, thus making it difficult to hold barrier and cut with scissors or a knife. 3) Finally, the methods which are taught in this application are not suitable, reliable, or an effective way of obtaining a new wick for relighting, especially for use in a candle.

Testing of said method mentioned prior, shows that simply using a cylinder which protects and encircles said reignition portion of wick is extremely difficult to remove for the user. Once the candle is extinguished and the fuel hardens, the cylinder cannot be removed with ease or by hand. This means that a user would have to remove cylinder immediately following the extinguishing of each flame. This method could cause injury to user when they would come in contact with the hot fuel.

The present invention has not only been designed to automatically extinguish a candle flame in equal-timed intervals but has been designed to relight a candle successfully for further use. The relighting process includes folding the wick segment at the top prior to securing it into the bottom of the non-flammable hollow tubular shape fitting. This is done to allow an adequate amount of new wick to be exposed. Once the appliance is removed, the top wick segment will extend at least ¼ of an inch above the candle body for relighting. The appropriate amount of wick for relighting is necessary to maintain an effective burning process for any candle.

Further more, there are many patent devices designed to extinguish a candle flame at the base of a candle. For example, U.S. Pat. No. 4,003,346,3 teaches that a wick holder supports a wick at the bottom of a candle. The wick holder material causes the flame on the wick to extinguish when it reaches the holder. However, an average size candle can burn for 60–95 hours prior to reaching said holder. That time frame is entirely to long to leave a burning candle unattended.

According to U.S. Pat. No. 3,013,424,6, a wick of a candle is anchored above the bottom of the candle a flame extinguishing distance so that the wick is extinguished by the candle's molten solid fuel when the wick is consumed. Placement of wick in this manner helps to eliminate burn through. Additionally, a bottom cavity may be formed in the candle. The cavity may be used for the purpose of helping to anchor the wick a desired flame extinguishing distance above the bottom surface of the candle. This process eliminates the flame prior to reaching the base of the candle. Unfortunately, this process stops the flame from burning at a point undesirable to a user, leaving on average 2 to 3 inches of a useable candle unusable.

Again, U.S. Pat. No. 4,332,548 discloses a transparent safety disc at the bottom of a candle. The safety disc is formed by a thermoplastic polyamide resin, combined with a flammable solvent for the resin that is compatible with the candle material. The candle material. The candle is also transparent. A wick holder and wick are placed on a layer of the resin mixture followed by pouring the candle material around the wick and wick holder and over the resin layer. The safety disc layer helps prevent flameups due to its high melting point and other characteristics which render it substantially non-flammable in the presence of a candle flame. Amount of burning time is too long prior to the flame extinguishing in the absence of said user.

Other devices for extinguishing a candle flame are known. However, they are complicated or they take away from the decorative decor of a candle. Such as taught by U.S. Pat. No. 6,494,708, which describes a method and apparatus for a lighted device in a container. The safety device is comprised of a closing device, an attachment device, and a holding device. The safety device further contains a coupler configured to operatively couple the closing device, the attachment device, and the holding device so that the closing device moves between a first and second position. There is also an extension coupled to and extending from a surface of the closing device, a securing system coupled to the attachment device, and a timing device is operatively configured to interact with extension when the closing device is in the second position to actuate movement of the closing device into the first position so that the lighted device in the container is extinguished in a predetermined amount of time.

U.S. Pat. No. 4,818,214, describes a candle having a heat shrinkable sleeve around the candle near the base. When the candle burns down sufficiently that the candle flame is near the sleeve, the heat activates the sleeve, causing it to shrink inwardly, constricting the wick and extinguishing the flame.

The present invention placed inside a candle is simple to use, requires no maintenance, is inexpensive, worry free, easy to manufacture and does not take away from the appearance of the candle. The wick, once assembled is simply held in place prior to candle wax being poured around it. Candle can be lit and user can forget about it. The candle wick will burn in the same manner as any other candle but will extinguish a flame in 2 hours. When the user is ready to relight their candle, they simply remove the exposed appliance by pulling the tab, discarding and relighting the new wick that is present. The process will repeat itself every 2 hours until the entire candle is consumed. The extinguishing time is contingent upon several different variables such as diameter of candle, type of fuel used and length of wick fragments. User of said candle is free to enjoy the lovely fragrance and any decor of their candles but the chore of remembering to blow it out no longer exists.

SUMMARY OF INVENTION

A wick that is designed to interrupt the burning process in equal timed intervals by cutting off the flow of fuel to the wick. The wick is comprised of wick segments linked with non-flammable hollow tubular shaped appliances. A tab which is located on the top rim of each appliance for easy removal. The tab is in an upward position and parallel to the wick. The top of the wick is exposed at least ¼ of an inch above the body of said candle for lighting and the bottom portion of the wick segment is inserted and secured in the top half of the tubular shape appliance and secured in place. Another wick segment is then folded, inserted and secured in the bottom half of the hollow tubular shaped appliance. This process is repeated throughout the desired length of the wick. The wick will burn until it reaches the non-flammable tubular shaped appliance. Finally, the candle will stop burning due to lack of fuel and lack of wick. Once the wax is cooled, the user simply grasps the tab with the thumb and forefinger and pulls. This will expose a new wick for lighting. This process is repeated throughout the life of the candle. The life of the candle ends when last wick segment reaches wick stand which is located at the base of said candle.

The method of this invention and the equal-time intervals can be altered by increasing or decreasing the length of wick inserted into the bottom and top portion of the non-flammable hollow tubular shape appliance.

For example, testing of said invention was performed by placing the wick with the ability to extinguish a candle flame in a paraffin wax candle which measured 4 inches in height and 3 inches in diameter. The wick segments used measured ⅜ of an inch. The non-flammable tubular shaped appliances measured ½ of an inch in length and approximately 2.5 centimeters in diameter. As mentioned earlier the wick segments were linked with appliances over the entire length of wick A standard wick stand was secured in place at the base of the candle with wax. The exposed top wick segment measuring ¼ of an inch was lit. The flame extinguished in 2 hours. The candle was cooled, appliance was removed, a new ¼ of an inch wick was present and candle was relit. The flame extinguished again in 2 hours.

Three separate tests were performed in the same manner mentioned. Each time the flame successively extinguished every 2 hours.

DESCRIPTION OF THE PREFERRED EMBODIMENT

Figure 1:
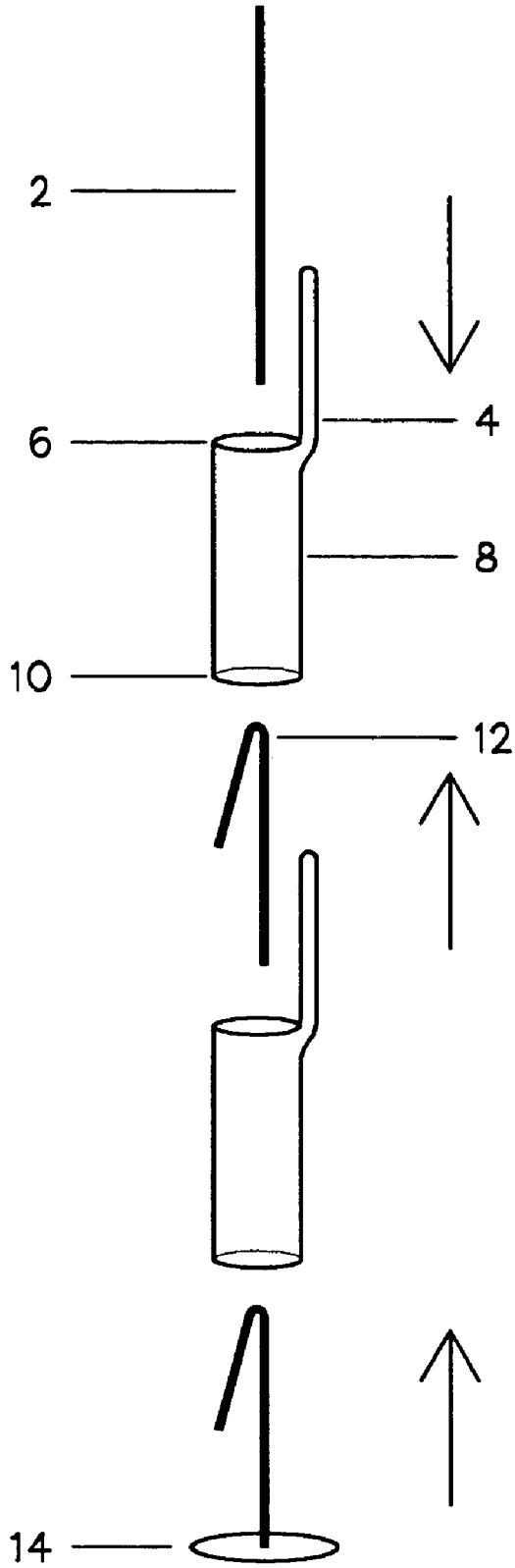
FIG. 1, is an exploded view showing the Smart Wick in the order of assembly.

Referring to the drawing, and particularly to FIG. 1, which depicts an exploded view of the Smart Wick. This figure shows the method in which each item is joined together to create the preferred embodiment that will automatically extinguish a candle flame in equal-time intervals. This is done by taking a wick segment, which should be considered first wick portion, Reference No. 2, with dimensions between about ½ to 3 inches in length, and securing it by slighting crimping small portion of bottom end into top of open face Reference No. 6, with dimensions between about 1 to 4 centimeters, of a non-flammable hollow tubular shape appliance Reference. No. 8. Reference no. 8 is a non-flammable hollow tubular shape appliance with dimensions between about ¼ to 1 inch in length and ½ to 4 centimeters diameter. Said appliance 8, is made from non-flammable material, such as, metal, steel, aluminum, copper, glass or plastic. Reference No. 8 is used to house portions of each wick segment and is equipped with a tab 4. The tab is attached to top body cavity of said appliance 8, and sits in an upward position. The tab attachment 4, purpose is to assist in the easy removal of each appliance, which will then expose new wick 12 for relighting. Reference No. 4 is made from non-flammable material, such as, metal, steel, aluminum, copper, glass or plastic. Reference No. 12 illustrates the folding of next wick, prior to being secured into bottom open face Reference No. 10 of said appliance 8. Second wick segment which ½ of an inch of top portion of 12 is folded. A small portion of the bottom end of 12 is then secured into top of open face of another said appliance. This process is repeated over the entire measurement lengthwise of said wick. The bottom end of last wick segment is secured to a wick stand 14, which is standard for the candle making industry.

FIG. 1, shows the process in which said wick is assembled. The placement of said appliances 8, as well as the length of each wick segment 2 and 12 can determine the equal-time intervals that will occur in a candle. The equal-time intervals can range from 1–5 hours.

Figure 2:
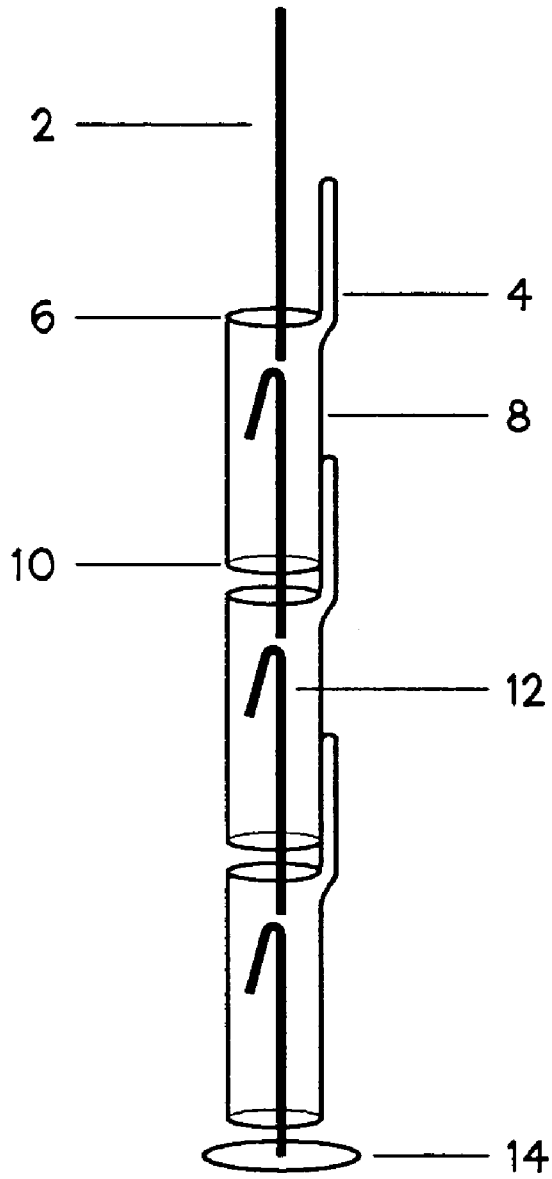
FIG. 2, is a completed frontal view of the Smart Wick assembled.

FIG. 2, illustrates frontal view of the Smart Wick's completed assembly. Assembly length is dependent upon depth of said candle that it will be housed in. The wick may require more or less wick segments and appliances. Wick segment 2 is secured into 6, top of open face appliance 8, the next folded portion of wick 12 is secured into 10 bottom open face of appliance 8. The other portion of wick 12 is secured into next top open face appliance. This is repeated until length is completed.

Figure 3:
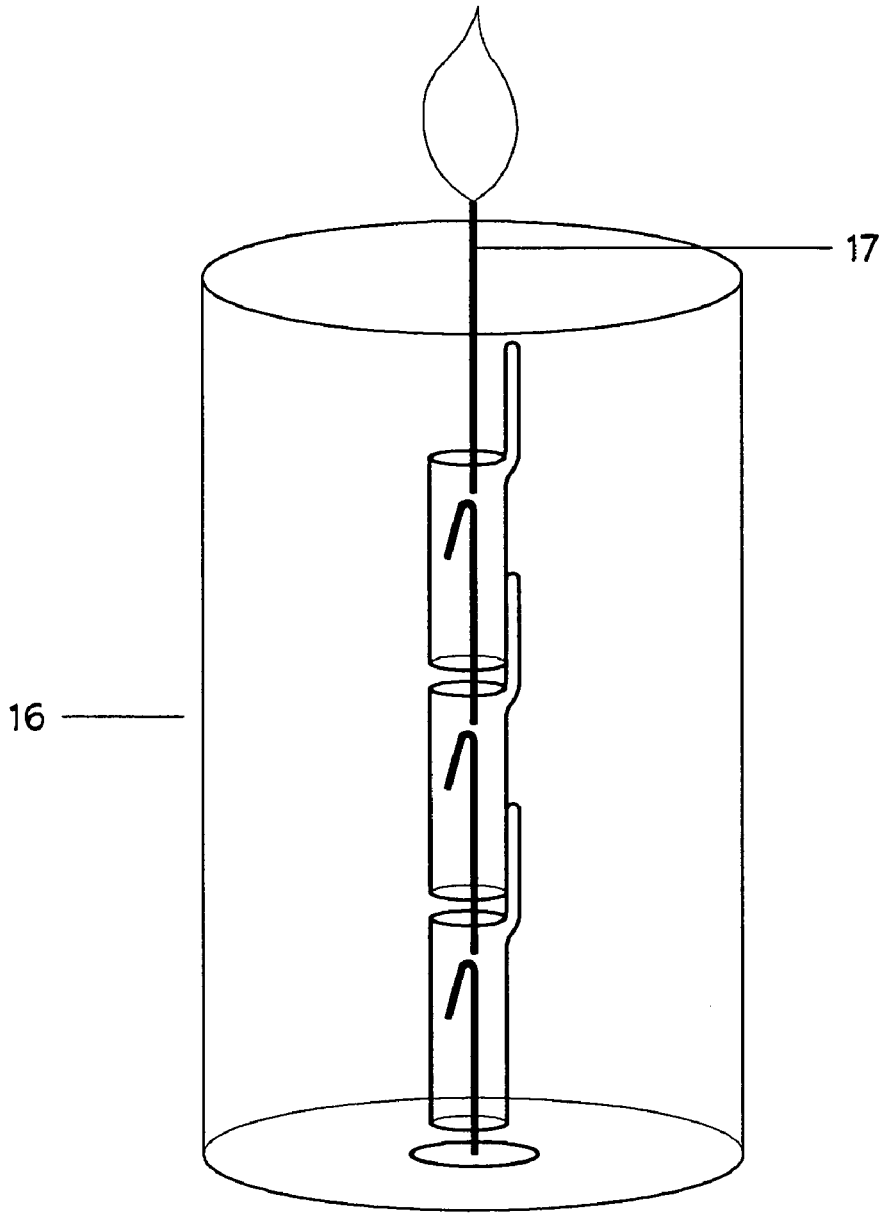
FIG. 3, is a cross sectional view of the completed Smart wick within said candle said candle is now self extinguishing.

FIG. 3, depicts a cross sectional view of a completed Smart Wick 17, inside candle body 16. By placing a completed wick inside said candle body Reference No. 16, the candle itself becomes a self extinguishing candle that will extinguish a flame in equal-time intervals and can be easily relit for further use.

Figure 4:
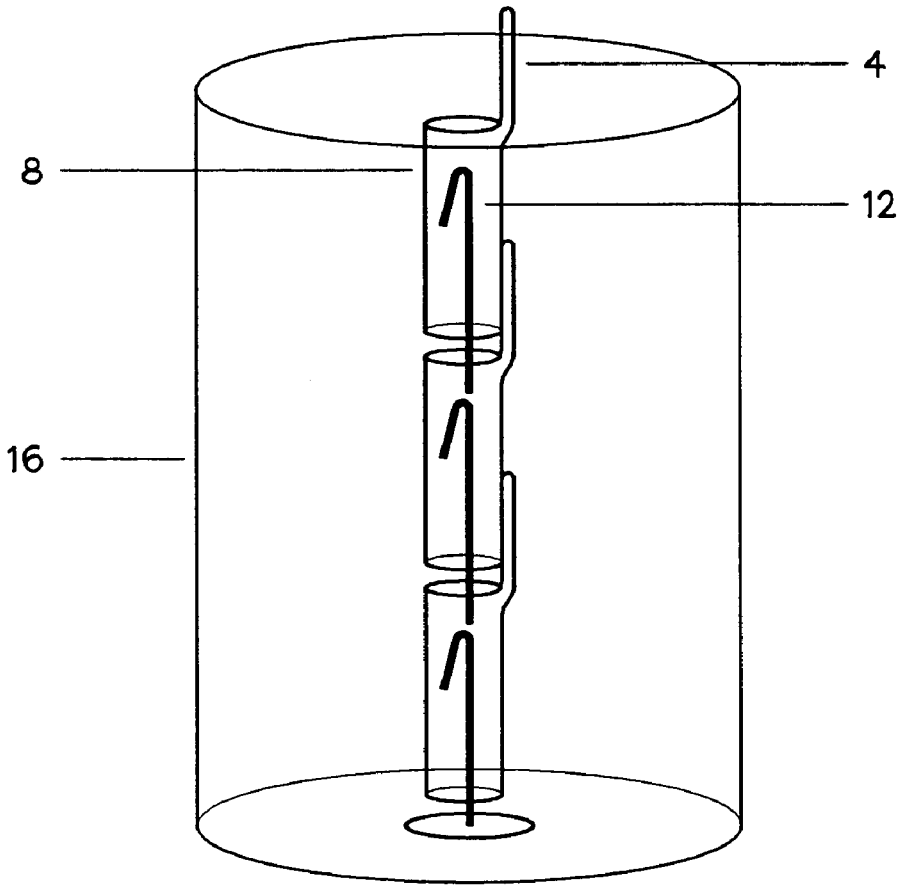
FIG. 4, is a cross sectional view of the candle after first wick segment is consumed and the tab to remove said appliance is exposed.

FIG. 4, illustrates how a candle, Reference No. 16, operates as a self extinguishing candle. once first wick segment is consumed and the flame extinguishes appliance 8 is partially exposed. The tab 4 is fully exposed above candle body 16. The tab is pulled with thumb and forefinger for removal of said appliance 8. Reference No. 8 will disengage from candle body with ease. Folded wick portion 12 will unfold as appliance 8 is pulled off. This will expose the upper portion of wick, which will extend itself at least ¼ of an inch above remaining candle body for relighting.

Figure 5:
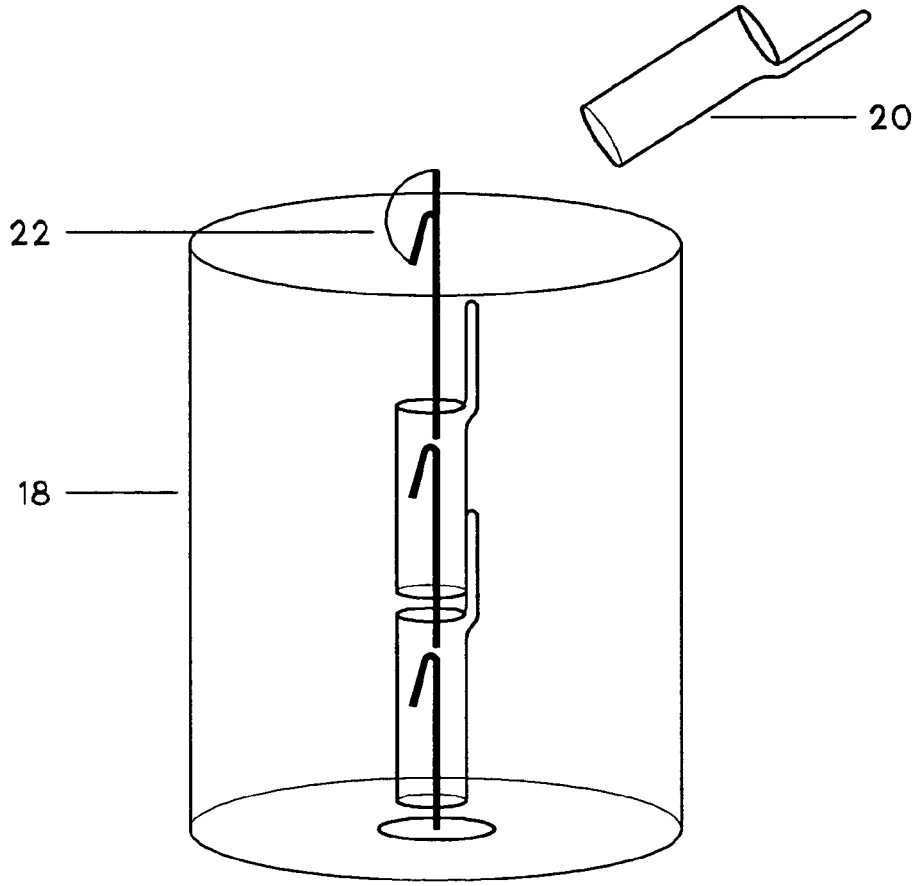
FIG. 5, is a cross sectional view of the candle which illustrates the unfolding method of new wick segment and the removal of the said appliance.

FIG. 5, shows how the next wick 22 exposes itself above the body of a self-extinguishing candle Reference No. 18. The unfolding of wick 22 is done for the purpose of having at least ¼ of inch of new wick for relighting after appliance 20 has been completely removed with ease. This process is repeated over the entire life cycle of said candle.

What we claim as our invention is:

1. A self-extinguishing candle, comprising:

a. a candle body comprising a fuel;

b. a plurality of wick appliances, said wick appliances each comprising an elongated tubular shell defining an annular interior, having an upper face and a lower face, said upper and lower faces disposed at either end of each wick appliance in a plane orthogonal to the longitudinal axis of the wick appliance, wherein the wick appliances' longitudinal axes are collinearly aligned in a series within the candle body, having a last wick appliance at one end of the series; and c. a plurality of wick segments, wherein one of the wick segments is enclosed in the annular interior of each wick appliance, each wick segment having a top end section and a bottom end section, wherein the bottom end section of each wick segment extends beyond the lower face of the enclosing wick appliance wherein the top end section of at least one of the wick segments is folded within the annular interior of its enclosing wick appliance and the bottom end section of each wick segment, other than in the last wick appliance, extends into the annular interior of an adjacent wick appliance.

2. The self-extinguishing candle of claim 1, wherein the fuel is wax.

3. The self-extinguishing candle of claim 1, wherein the bottom end section of the wick segment in the last wick appliance engages with a wick stand.

4. The self-extinguishing candle of claim 1, wherein a tab is disposed on each wick appliance proximate to its upper face.

5. The self-extinguishing candle of claim 3, wherein the tab extends beyond the upper face of the wick appliance.

6. The self-extinguishing candle of claim 1, wherein the wick appliances are constructed of a non-combustible material.

7. The self-extinguishing candle of claim 6, wherein the non-combustible material is selected from a group consisting of metal, steel, aluminum, copper, glass and plastic.

8. The self-extinguishing candle of claim 1, wherein the length of the wick appliances parallel to the longitudinal axis is between ¼ inch and 1 inch.

9. The self-extinguishing candle of claim 1, wherein the width of the wick appliances perpendicular to the longitudinal axis is between ½ centimeter and 4 centimeters.

* * * * *